United States Patent [19]

Mobley

[11] Patent Number: 4,832,272

[45] Date of Patent: May 23, 1989

[54] LAMINATOR UNWIND ROLL STAND

[75] Inventor: George A. Mobley, Roebuck, S.C.

[73] Assignee: Milliken Research Corporation, Spartanburg, S.C.

[21] Appl. No.: 229,253

[22] Filed: Aug. 8, 1988

[51] Int. Cl.[4] ..... B65H 19/16; B65H 19/00

[52] U.S. Cl. ..... 242/58.4; 242/58.5; 156/502; 156/505

[58] Field of Search ..... 242/58, 58.1, 58.2, 242/58.3, 58.4, 58.5, 68.7; 156/502, 504, 505, 507

[56] References Cited

U.S. PATENT DOCUMENTS

| | | | |
|---|---|---|---|
| 2,134,656 | 10/1938 | Breth | 242/68 |
| 3,042,332 | 7/1962 | Astley | 242/58.3 |
| 3,065,923 | 11/1962 | Karr | 242/58.3 |
| 3,077,069 | 2/1963 | Kooistra | 57/127.5 |
| 3,394,897 | 7/1968 | Martin, Sr. | 242/54 |
| 3,412,950 | 11/1968 | Martin, Sr. | 242/54 |
| 3,468,529 | 9/1969 | Martin, Sr. et al. | 270/31 |
| 3,474,978 | 10/1969 | Klose | 242/58 |
| 3,495,783 | 2/1970 | Headington et al. | 242/58.4 |
| 3,528,620 | 9/1970 | Roscoe | 242/58.4 |
| 3,586,006 | 6/1971 | Wendt | 242/58.4 X |
| 3,939,031 | 2/1976 | Takimoto | 242/58.4 X |
| 3,972,487 | 8/1976 | Costa | 242/687 |
| 4,084,761 | 4/1978 | Kuckhermann | 242/586 |
| 4,469,286 | 9/1984 | Greding | 242/65 |
| 4,632,325 | 12/1986 | Feyerl et al. | 242/55 |
| 4,668,328 | 5/1987 | Kyytsönen | 242/58.5 X |

*Primary Examiner*—Daniel P. Stodola
*Assistant Examiner*—John M. Eghtessad
*Attorney, Agent, or Firm*—Earle R. Marden; H. William Petry

[57] ABSTRACT

An apparatus to splice a new roll of fabric or material to a roll of material being dissipated from a roll stand by supply to a material consuming machine. The invention includes a pivotally mounted vacuum device which supplies the end of the new material to a position from which it is mated with the end of the material being unwound and is adhered thereto to splice the two materials.

4 Claims, 4 Drawing Sheets

LAMINATOR UNWIND ROLL STAND

This invention relates to an efficient unwind roll stand which allows easy and efficient replacement of an exhausted fabric roll supplying fabric to another point of use such as a lamination machine.

Unwind stands for material such as paper, fabric, etc. have been known for years but replacement of an exhausted roll of material in a continuous operation has always been a problem. First the old, almost exhausted roll of material has to be attached to the new supply of material and then, when the new material has been placed in communication with the material consuming machine, the shaft and/or roll of the exhausted material must be removed from the unwind machine.

Therefore, it is an object of the invention to provide a new and novel material unwind stand which provides ready replacement of an exhausted supply of material with a new supply of material.

Other objects and advantages of the invention will become readily apparent as the specification proceeds to describe the invention with reference to the accompanying drawings, in which.

Figure 1:
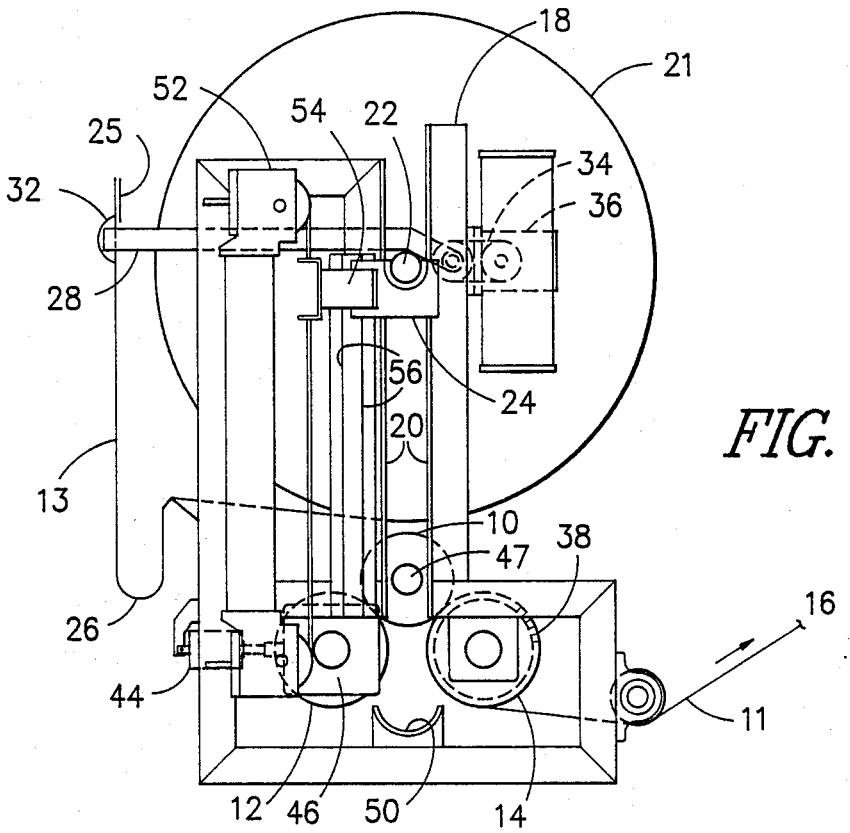
FIGS. 1–6 are schematic representations of the various steps in replacing a spent roll of material in an unwind machine.

In the preferred form of the invention the unwind stand is supplying fabric continuously to an extruder laminator which is laminating paper to the back of the fabric being supplied from the unroll stand. This, obviously, is only the preferred use of the herein-described invention since the type of material being unwound and its end use is not critical.

In normal operating position the supply roll 10 of fabric 11 rests on free turning bed rolls 12 and 14 and is pulled therefrom around the perforated roll 12 towards the laminator (not shown) in the direction indicated by the reference number 16. The fabric roll 10, the free turning rolls 12 and 14 and the rest of the roll stand apparatus are supported on a suitable frame 18 which provides a slot 20 therein to allow a replacement fabric roll 21 to be mounted on the roll stand while the fabric from the roll 10 is being supplied to the laminator.

When the roll of fabric 10 runs down to a diameter of approximately 8 inches the reserve or replacement roll 21 is placed in the position shown in FIGS. 1–4 with its shaft 22 located in the slidable bearings 24. Prior to positioning the roll, the end of the fabric on the roll has been folded back and temporarily taped. Also a double-sided adhesive tape 25 has been placed on the outside of the fold so that the tape 25 will be facing the roll 21 when the fabric 13 is manually unrolled to provide the tension loop 26 as shown in FIG. 1. Then, after the replacement roll 21 has been placed in position, the vacuum bar, consisting of a pair of spaced arms 28 and vacuum chamber 32 extending therebetween, is pivoted from its neutral position (FIGS. 3–6) to the position shown in FIG. 1 by a suitable chain 34 and drive motor 36. In the position shown in FIG. 1 the fabric 13 is held to the perforated face of the vacuum chamber 32 between the arms 28. A suitable source of vacuum pressure (not shown) is connected to the vacuum chamber 32 and the roll 14 for reasons hereinafter explained.

Figure 2:
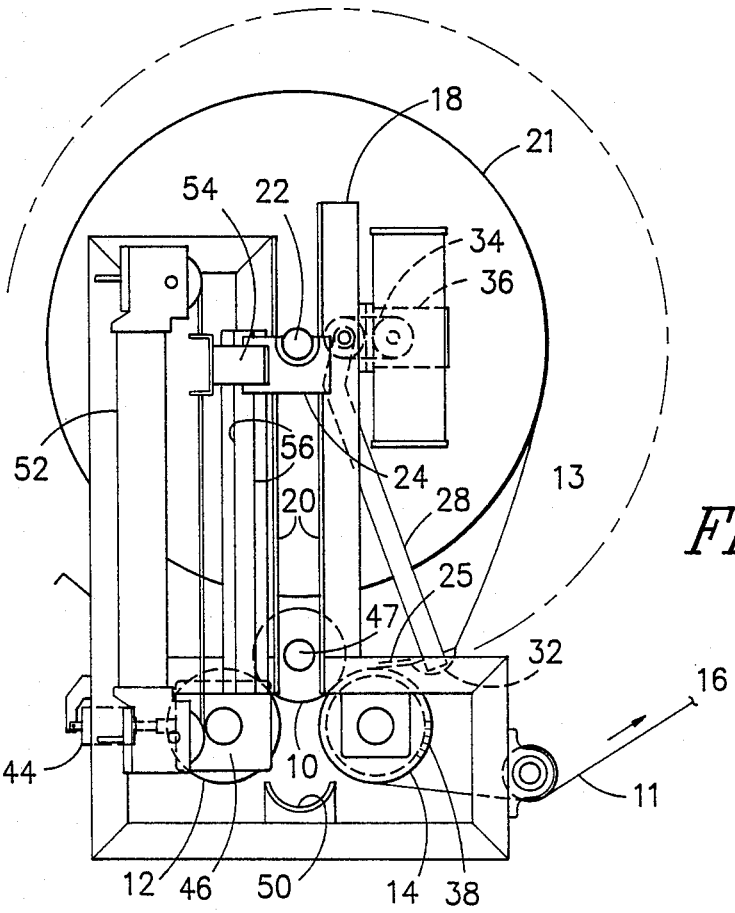
Figure 3:
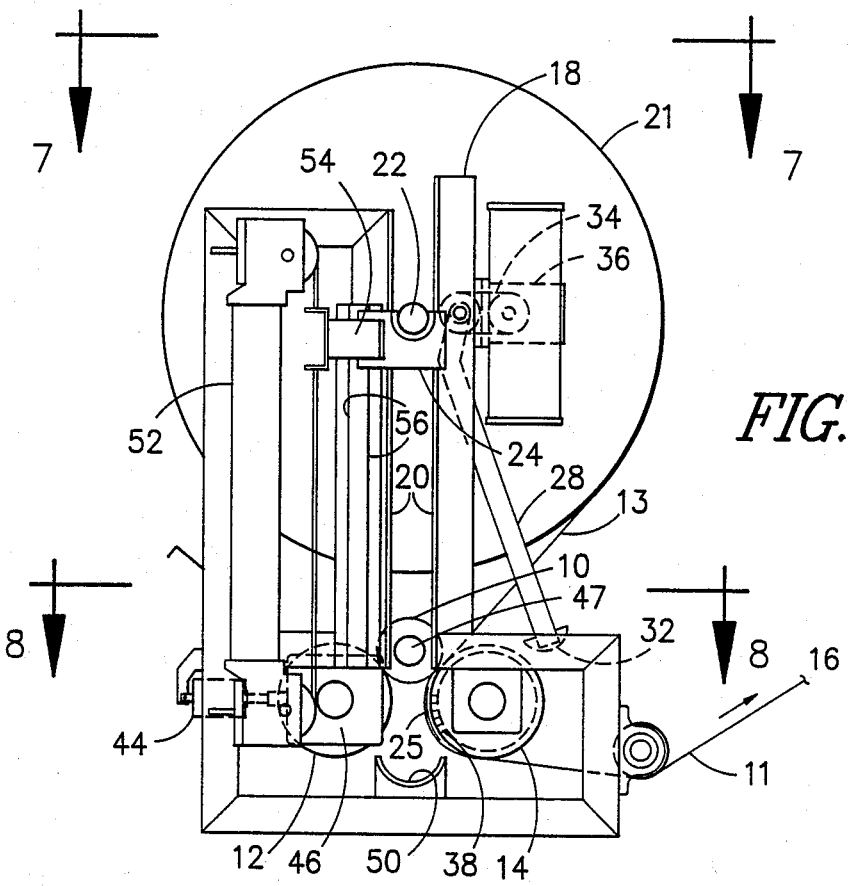
Figure 4:
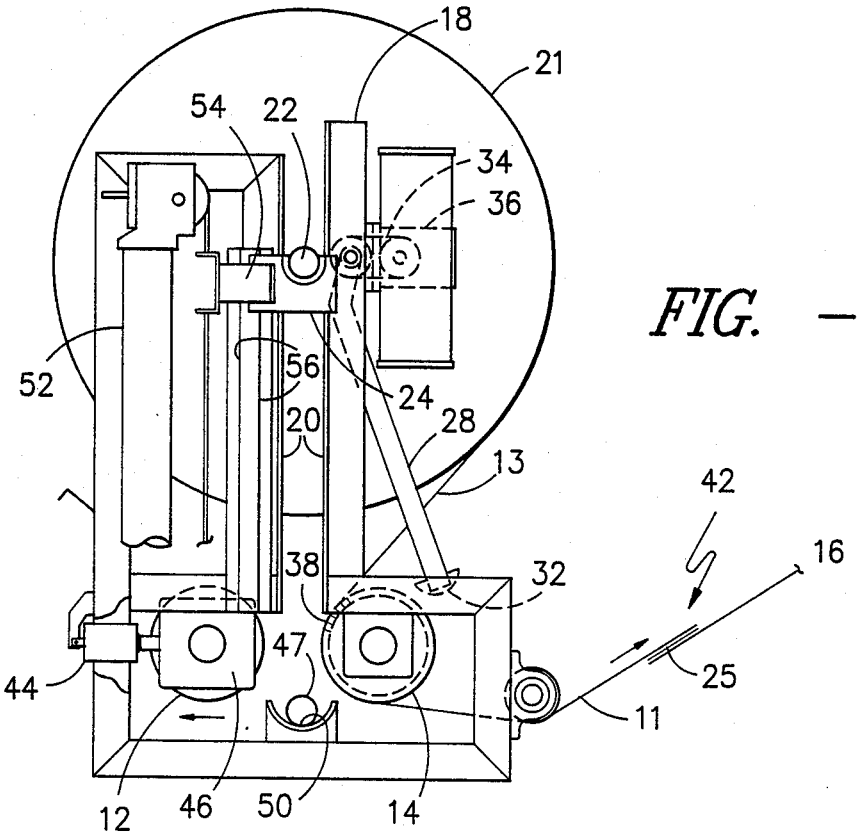
Figure 5:
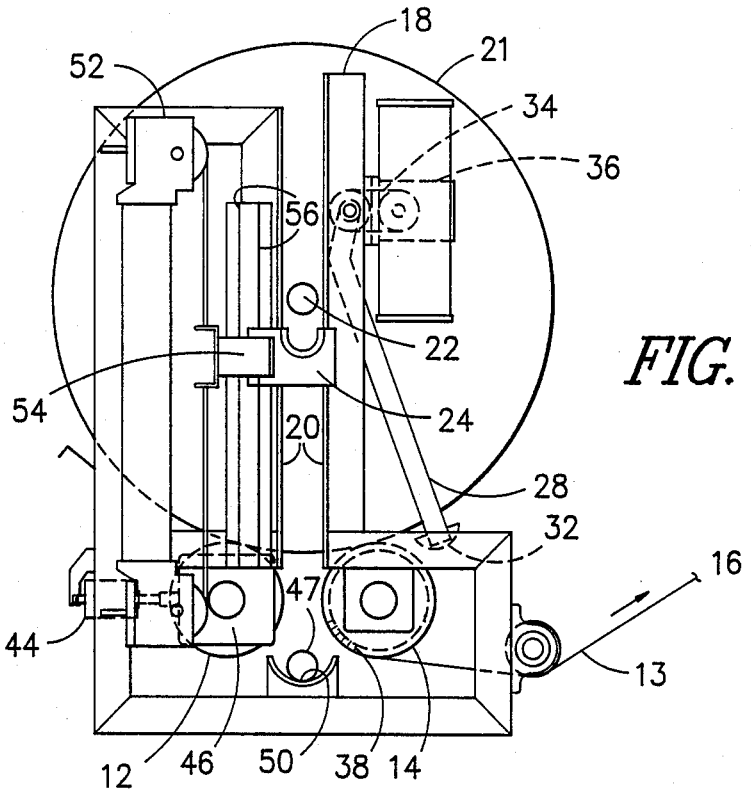
Figure 6:
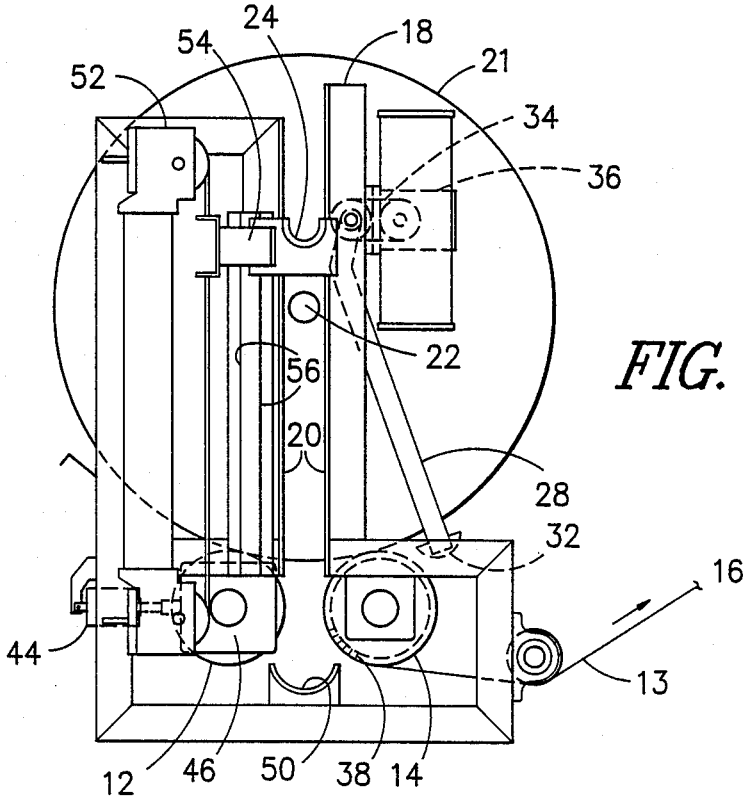
Figure 7:
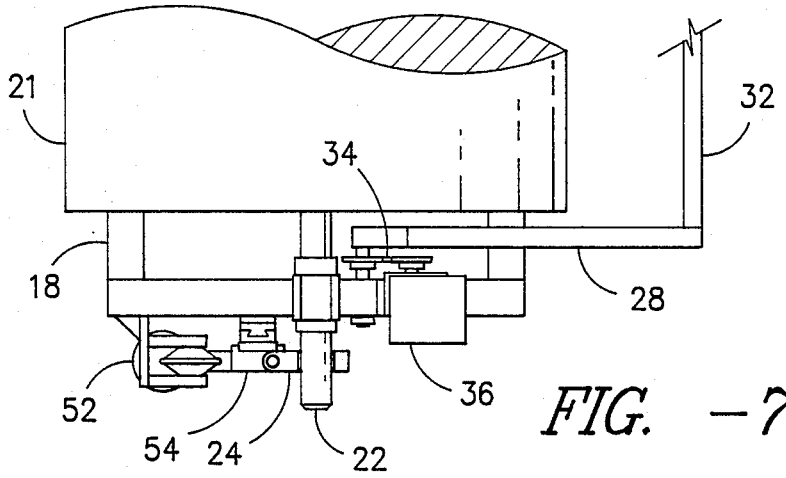
FIG. 7 is a view taken on line 7–7 of FIG. 3.
Figure 8:
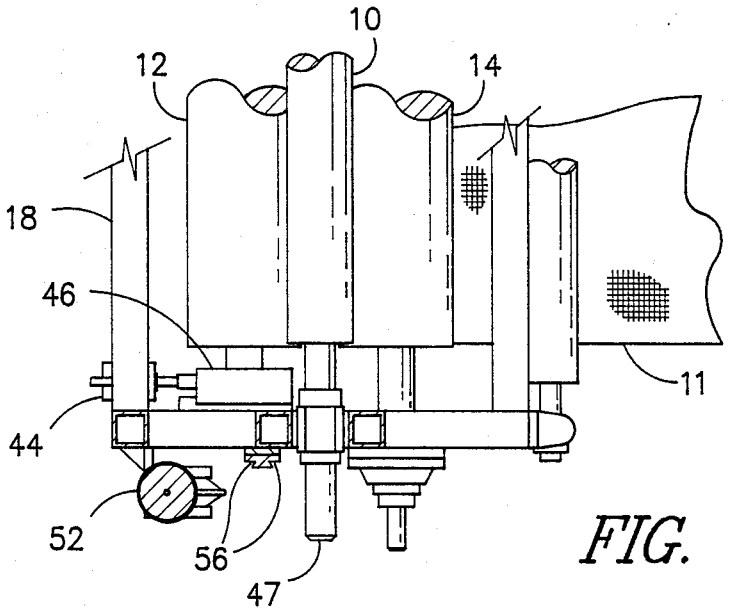
FIG. 8 is a partial sectional view taken on line 8—8 of FIG. 3.

After the fabric 13 has been secured against the perforated face of the vacuum chamber 32 the drive motor 36 is reversed to pivot the arm 28 and the end of the fabric 13 to the waiting position shown in FIG. 2. At this position the vacuum pressure is maintained on the fabric 13 until it is desired to splice the new roll 21 to the old roll 10 being disspated.

When the roll 10 has been reduced to the point where it is necessary to splice the fabric 11 of the roll 10 to the fabric 13 on the replacement roll 21, the vacuum induced in the vacuum chamber 32 is reduced or shut down while a vacuum is pulled on the inside of the roll 14. When the perforated portion 38 of the roll 14 rotates to a point under the tail of the replacement roll fabric 21, the fabric 13 will be attached thereto and pulled away from the vacuum bar 32. The roll 14 carries the taped tail of the replacement roll fabric 13 into the nip with the old fabric 11 where the double-sided stick tape adheres to the fabric 11 of the roll 10 to provide a splice 42 between the fabrics 11 and 13 on rolls 10 and 20, respectively.

Figure 9:
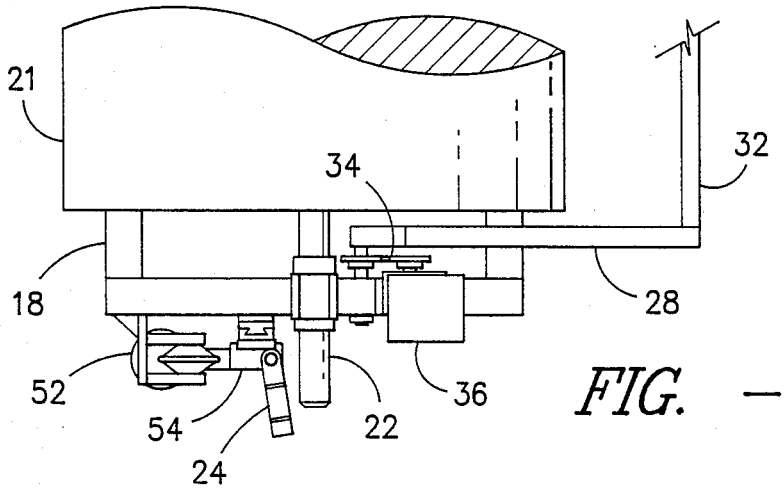
FIG. 9 is a view similar to FIG. 7 showing the shaft support pivoted out of operational position.

After the splice 42 has been made, the piston 44 will be activated to pull the bearing block 46 for the roll 12 outward to allow the shaft 47 of the exhausted fabric roll 10 to drop into the semicircular support 50 (FIGS. 4–7). After the exhausted roll shaft 47 has dropped into the support 50 the action of the piston 44 will be reversed to slide the roll 12 back into operative position (FIG. 5) and the cable cylinder 52 actuated to lower the bearings 24, by movement of the slide member 54 in the guide groove 56, to allow the replacement roll 20 to contact the bed rolls 12 and 14. When the roll 21 has been placed in operative position on the bed rolls 12 and 14 the bearings 24 will be pivoted outwardly (FIG. 9) so that the bearings 24 can be slid upwardly and then pivoted inwardly (FIG. 6) ready for engagement by the shaft of a replacement roll for the roll 21 being consumed.

It can be seen that the hereini-described material roll stand provides for ease of splicing a replacement roll to the tail of an almost exhausted roll of material without interrupting the process using the material coming from the roll stand. Furthermore, the apparatus described provides ready removal of the old exhausted material roll while allowing continuous supply of material to a consuming machine such as a laminator.

Although the preferred embodiment of the invention has been described, it is contemplated that many changes may be made without departing from the scope or spirit of the invention and it is desired that the invention be limited only by the claims.

I claim:

1. Apparatus to continuously unwind a web of material comprising: a frame, a pair of bed rolls rotatably mounted to said frame to support a first roll of material during unwinding thereof, one of such rolls having a portion thereof perforated, a first means mounted to said frame above said bed rolls to support a second roll of web material, a second means pivotally mounted to said frame to move the tail of the second web of material from one position to a second position adjacent said perforated roll and means to cause the tail of the second web of material to be spliced to the tail of the web of material being unwound and is expended.

2. The apparatus of claim 1 wherein said second means includes a vacuum chamber to exert a vacuum pressure on the tail of the second roll of web material.

3. The apparatus of claim 2 wherein a means is connected to said frame to slide one of said bed rolls away from the other of said bed rolls to allow the shaft of the first roll of web material to drop therebetween when the first roll of web material is exhausted.

4. The apparatus of claim 3 wherein means are mounted to said frame and said first means to slide said first means downward to place the second roll of web material on said bed rolls after the shaft of the first roll of web material has been dropped therebetween.

* * * * *